US006397178B1

(12) United States Patent
Benyassine

(10) Patent No.: US 6,397,178 B1
(45) Date of Patent: May 28, 2002

(54) DATA ORGANIZATIONAL SCHEME FOR ENHANCED SELECTION OF GAIN PARAMETERS FOR SPEECH CODING

(75) Inventor: Adil Benyassine, Irvine, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/157,083

(22) Filed: Sep. 18, 1998

(51) Int. Cl.[7] ..... G10L 11/00
(52) U.S. Cl. ..... 704/230; 704/229
(58) Field of Search ..... 704/230, 219, 704/220, 223, 225, 229

(56) References Cited

U.S. PATENT DOCUMENTS 5,173,941 A * 12/1992 Yip et al. ..... 704/219
5,179,594 A * 1/1993 Yip et al. ..... 704/219
5,187,745 A * 2/1993 Yip et al. ..... 704/219
5,208,862 A * 5/1993 Ozawa ..... 704/219
5,233,660 A * 8/1993 Chen ..... 704/221
5,261,027 A * 11/1993 Taniguchi et al. ..... 704/200
5,682,407 A 10/1997 Funaki
5,699,485 A * 12/1997 Shoham ..... 704/223
6,052,660 A * 4/2000 Sano ..... 704/221

FOREIGN PATENT DOCUMENTS

WO WO 96/35208 11/1996
WO WO 97/31367 8/1997

* cited by examiner

*Primary Examiner*—Fan Tsang
*Assistant Examiner*—Michael N. Opsasnick
(74) *Attorney, Agent, or Firm*—Farjami & Farjami LLP

(57) ABSTRACT

A vector quantizer (VQ) table is arranged in increasing order with regard to a $g_c$ gain value (as may be represented by a prediction error energy $E_n$). The single stage VQ table is then organized into two-dimensional bins, with each bin arranged in increasing order of a $g_p$ gain value. A one-dimensional auxiliary scalar quantizer is constructed from the largest prediction error energy values from each bin. The prediction error energy values in the auxiliary scalar quantizer are arranged in increasing order of magnitude. In order to quantize input gain values, the auxiliary scalar table is searched for the best prediction error energy match. The VQ table bin corresponding to the best match in the auxiliary table is then searched for the best $E_n$ and $g_p$ match. Nearby bins may also be searched for a more optimal combination. The selected best match is used to quantize the input gain values.

20 Claims, 6 Drawing Sheets

DATA ORGANIZATIONAL SCHEME FOR ENHANCED SELECTION OF GAIN PARAMETERS FOR SPEECH CODING

BACKGROUND OF THE INVENTION

1. Field of the Invention

The present invention relates to the field of speech coding, and more particularly, to a robust, fast search scheme for a two-dimensional gain vector quantizer table.

2. Description of Related Art

A prior art speech coding system 200 is illustrated in FIG. 1. One of the techniques for coding and decoding a signal 100 is to use an analysis-by-synthesis coding system, which is well known to those skilled in the art. An analysis-by-synthesis system 200 for coding and decoding signal 100 utilizes an analysis unit 204 along with a corresponding synthesis unit 222. The analysis unit 204 represents an analysis-by-synthesis type of speech coder, such as a code excited linear prediction (CELP) coder. A code excited linear prediction coder is one way of coding signal 100 at a medium or low bit rate in order to meet the constraints of communication networks and storage capacities. An example of a CELP based speech coder is the recently adopted International Telecommunication Union (ITU) G.729 standard, herein incorporated by reference.

In order to code speech, the microphone 206 of the analysis unit 204 receives the analog sound waves 100 as an input signal. The microphone 206 outputs the received analog sound waves 100 to the analog to digital (A/D) sampler circuit 208. The analog to digital sampler 208 converts the analog sound waves 100 into a sampled digital speech signal (sampled over discrete time periods) which is output to the linear prediction coefficients (LPC) extractor 210 and the pitch extractor 212 in order to retrieve the format structure (or the spectral envelope) and the harmonic structure of the speech signal, respectively.

The format structure corresponds to short-term correlation and the harmonic structure corresponds to long-term correlation. The short-term correlation can be described by time varying filters whose coefficients are the obtained linear prediction coefficients (LPC). The long-term correlation can also be described by time varying filters whose coefficients are obtained from the pitch extractor. Filtering the incoming speech signal with the LPC filter removes the short-term correlation and generates an LPC residual signal. This LPC residual signal is further processed by the pitch filter in order to remove the remaining long-term correlation. The obtained signal is the total residual signal. If this residual signal is passed through the inverse pitch and LPC filters (also called synthesis filters), the original speech signal is retrieved or synthesized. In the context of speech coding, this residual signal has to be quantized (coded) in order to reduce the bit rate. The quantized residual signal is called the excitation signal, which is passed through both the quantized pitch and LPC synthesis filters in order to produce a close replica of the original speech signal. In the context of analysis-by-synthesis CELP coding of speech, the quantized residual signal is obtained from a code book 214 normally called the fixed code book. This method is described in detail in the ITU G.729 document.

The fixed code book 214 of FIG. 1 contains a specific number of stored digital patterns, which are referred to as code vectors. The fixed codebook 214 is normally searched in order to provide the best representative code vector to the residual signal in some perceptual fashion as known to those skilled in the art. The selected code vector is typically called the fixed excitation signal. After determining the best code vector that represents the residual signal, the fixed codebook unit 214 also computes the gain factor of the fixed excitation signal. The next step is to pass the fixed excitation signal through the pitch synthesis filter. This is normally implemented using the adaptive code book search approach in order to determine the optimum pitch gain and pitch lag in a "closed-loop" fashion as known to those skilled in the art. The "closed-loop" method, or analysis-by-synthesis, means that the signals to be matched are filtered.

The optimum pitch gain and lag enable the generation of a so-called adaptive excitation signal. The determined gain factors for both the adaptive and fixed code book excitations are then quantized in a "closed-loop" fashion by the gain quantizer 216 using a look-up table with an index, which is a well known quantization scheme to those of ordinary skill in the art. The index of the best fixed excitation from the fixed code book 214 along with the indices of the quantized gains, pitch lag and LPC coefficients are then passed to the storage/transmitter unit 218.

The storage/transmitter 218 of the analysis unit 204 then transmits to the synthesis unit 222, via the communication network 220, the index values of the pitch lag, pitch gain, linear prediction coefficients, the fixed excitation code vector, and the fixed excitation code vector gain which all represent the received analog sound waves signal 100. The synthesis unit 222 decodes the different parameters that it receives from the storage/transmitter 218 to obtain a synthesized speech signal. To enable people to hear the synthesized speech signal, the synthesis unit 222 outputs the synthesized speech signal to a speaker 224.

The analysis-by-synthesis system 200 described above with reference to FIG. 1 has been successfully employed to realize high-quality speech coders. As can be appreciated by those skilled in the art, natural speech can be coded at very low bit rates with high quality.

FIG. 2 is a block diagram illustrating more generally how a speech signal is coded. A digitized input speech signal is input to an LP analysis block 300. The LP analysis block 300 removes the short-term correlation (i.e. extracts the form and structure of the speech signal). As a result of the LP analysis, LPC coefficients are generated and quantized (not shown). The signal output by the LP analysis block 300 is known as a residual signal. This residual signal is quantized by the quantizer 302 using a fixed excitation codebook and an adaptive excitation codebook. At block 304 a fixed excitation gain $g_c$ and an adaptive excitation gain $g_p$ are determined. Gains $g_c$ and $g_p$ are then quantized at block 306. The indices for the quantized LPC coefficients, the optimal fixed and adaptive excitation vectors, and the quantized gains are then transmitted over the communications channel.

In CELP based speech coders, the adaptive excitation gain and the fixed excitation gain are often jointly quantized using a two-dimensional vector quantizer for efficient coding. This quantization process requires a search of a codebook whose size may range from 64 (6 bits) to 512 (9 bits) entries in order to find the best possible match for the input gain vector The search algorithm required to perform this search, however, is too complex for many applications. Thus, there is a need for a fast search algorithm to search a gain quantizer table. Moreover, it is desirable to have a robust quantizer table, that is, a quantizer table designed to minimize bit errors due to poor quality transmission channels.

SUMMARY OF THE INVENTION

A vector quantizer (VQ) table is arranged in increasing order with regard to a $g_c$ gain value (as may be represented by a prediction error energy $E_n$). The single stage VQ table is then organized into two-dimensional bins, with each bin arranged in increasing order of a $g_p$ gain value. A one-dimensional auxiliary scalar quantizer is constructed from the largest prediction error energy values from each bin. The prediction error energy values in the auxiliary scalar quantizer are arranged in increasing order of magnitude. In order to quantize input gain values, the auxiliary scalar table is searched for the best prediction error energy match. The VQ table bin corresponding to the best match in the auxiliary table is then searched for the best $E_n$ and $g_p$ match. Nearby bins may also be searched for a more optimal combination. The selected best match is used to quantize the input gain values. A VQ constructed accordingly, results in a robust and fast search scheme.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide a fast search scheme for a two-dimensional gain vector quantizer table.

In the following description, the present invention is described in terms of functional block diagrams and process flow charts, which are the ordinary means for those skilled in the art of speech coding for describing the operation of a gain vector quantizer. The present invention is not limited to any specific programming languages, or any specific hardware or software implementation, since those skilled in the art can readily determine the most suitable way of implementing the teachings of the present invention.

In order to efficiently transmit the excitation gains $g_c$ and $g_p$, the gains need to be quantized, i.e. limited to a few bits each. Prior art solutions have used codebooks to represent the gains, and more specifically, have quantized the gains as a single vector value. Problems that arise using this approach include determining an efficient search algorithm for searching the quantizer table, and limiting the sensitivity of the index representing the vector to channel error.

Figure 1:
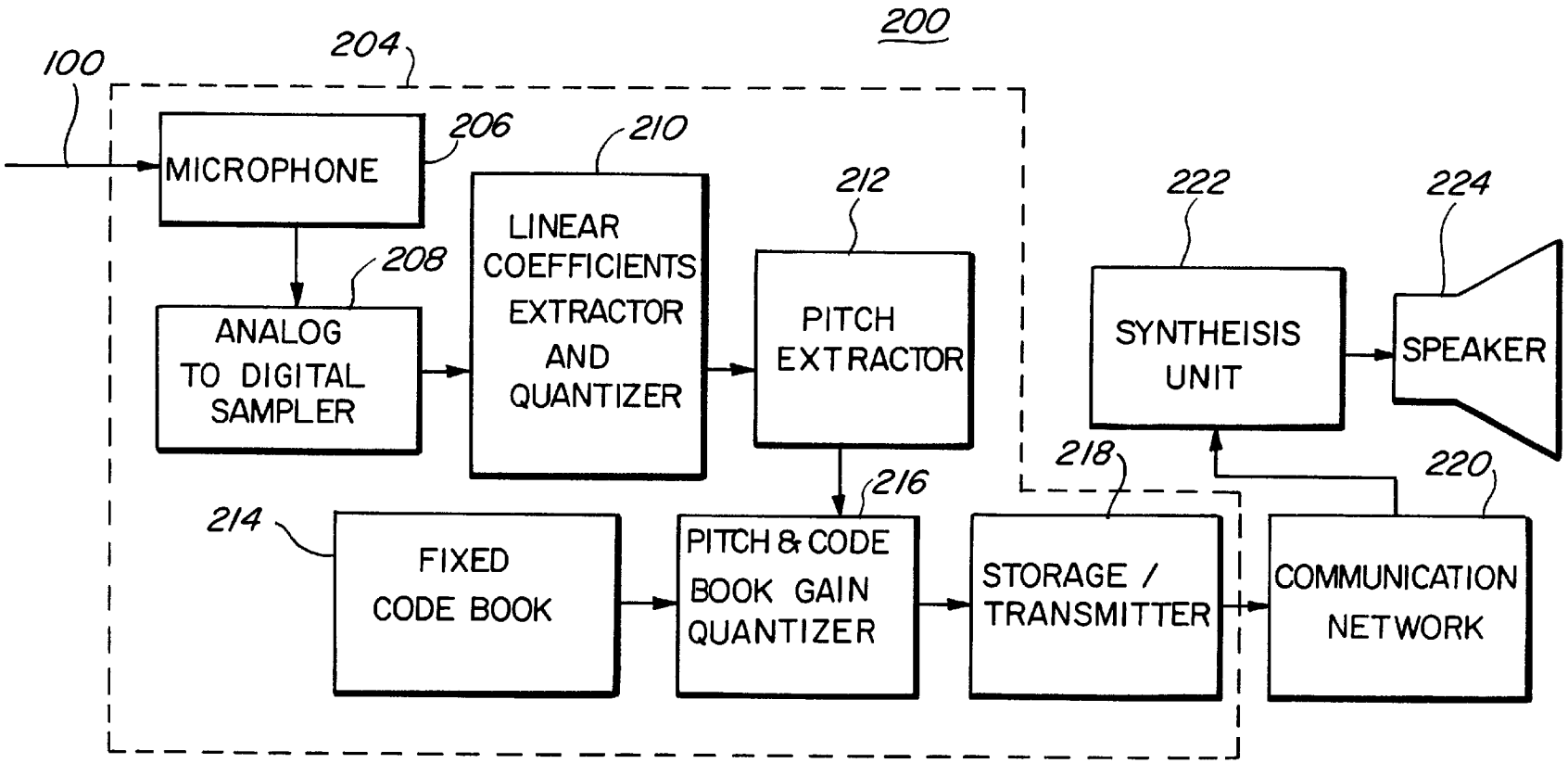
FIG. 1 PRIOR ART
FIG. 1 is a block diagram illustrating a speech coding system.
Figure 2:
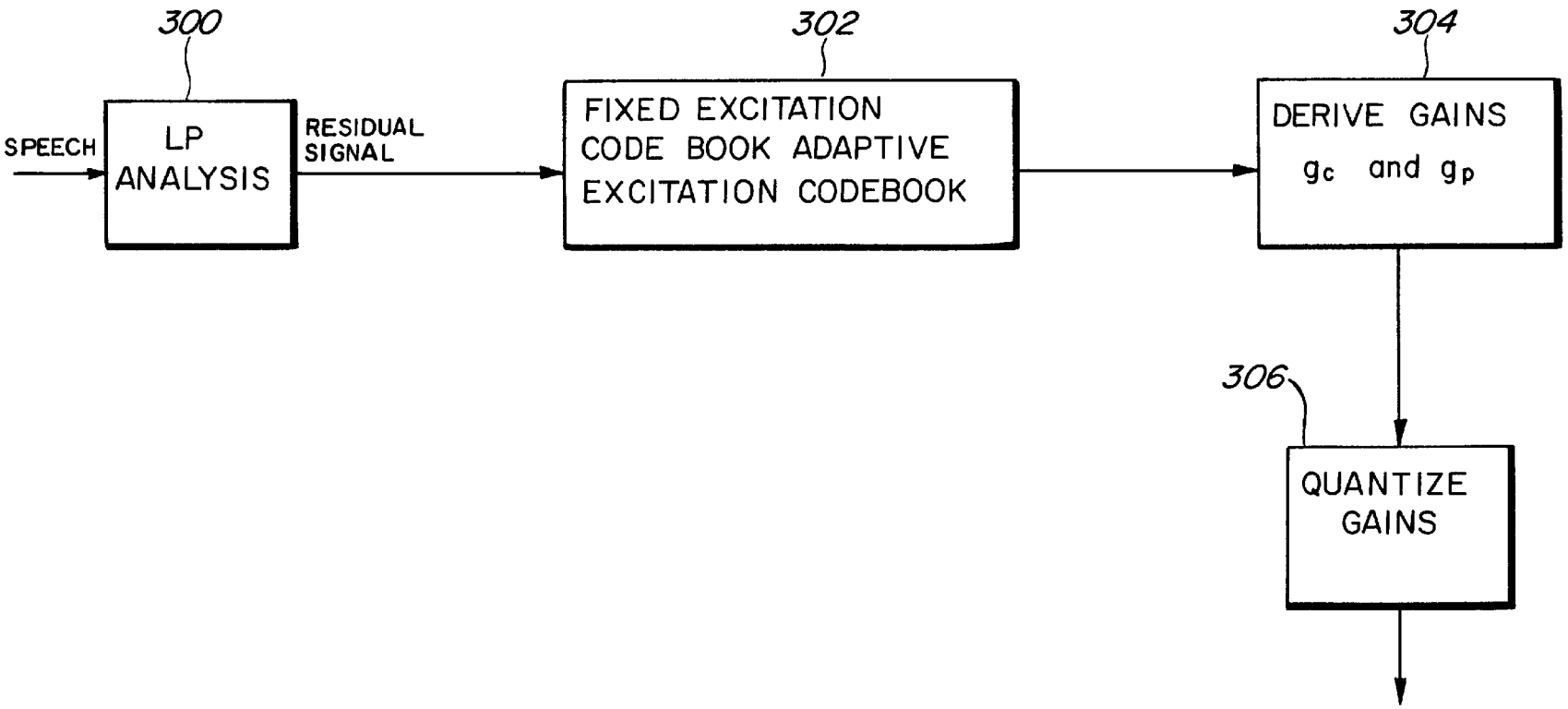
FIG. 2 PRIOR ART
FIG. 2 is a block diagram showing generally how a speech signal is coded.
Figure 3:
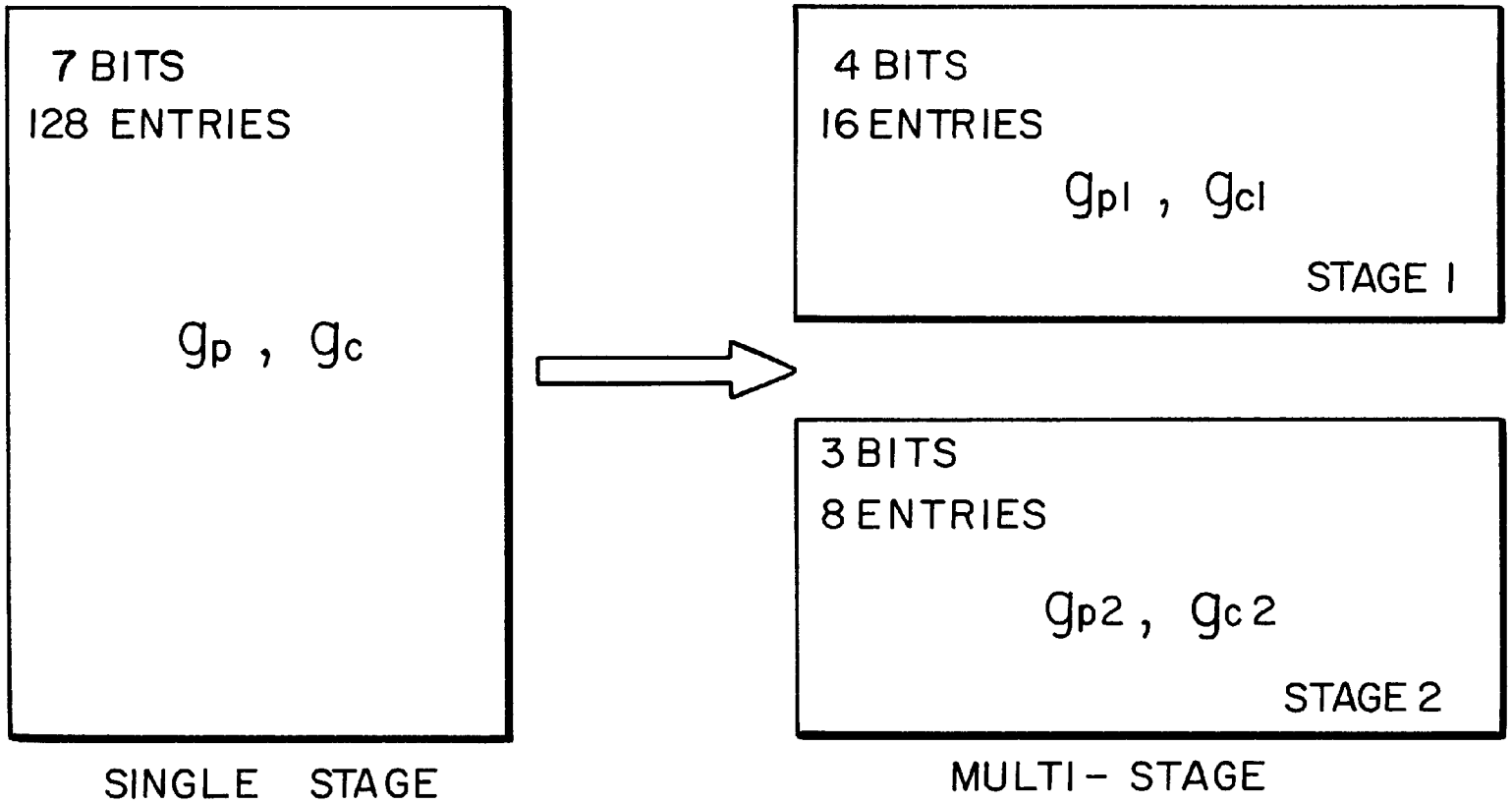
FIG. 3 illustrates a single stage vector quantizer table and a multi-stage quantizer table.

Some prior art solutions have transformed either the $g_c$ or $g_p$ gains into a different domain to provide a more efficient coding scheme. For example, one solution keeps $g_p$ the same, but transforms $g_c$ into a differential energy domain, which has a smaller dynamic range. Consider for example, the scaled fixed excitation signal $x_1(n)$:

$$x_1(n)=g_c*ex_1(n)$$

where $g_c$ is the fixed excitation gain and $ex_1(n)$ is the fixed excitation vector. In order to transform $g_c$ into a differential energy domain, the following steps are performed:

1) calculate $x_1(n)$
2) compute $x_1(n)$'s energy
3) transform $x_1(n)$'s energy into a logarithm domain (i.e. decibels)
4) calculate a linear prediction of energy using either
   a) auto-regressive (AR) prediction method OR
   b) moving average (MA) prediction method
5) calculate an prediction error energy $E_n$ by taking the difference between $x_1(n)$'s energy in a logarithm domain and the linear prediction of energy
6) use $E_n$ in combination with $g_p$ for gain quantization This transformation method is used in the present invention. However, even using the transformation, the codebook is still too large to search efficiently. For example, as shown in FIG. 3, a single stage codebook representing the gains as 7 bits would have 128 entries.

In order to provide a more efficient codebook search, one previous solution uses a multi-stage (usually two stages) vector quantizer. A two-stage quantizer is illustrated in FIG. 3. Each stage has fewer entries than a single stage codebook. For example, the first stage only has 16 entries (4 bits) and is designed to have more weight toward one of the gains ($g_p$). The second stage has eight entries (3 bits) and is designed to have more weight toward the other gain ($g_c$, as represented by $E_n$). The final $g_p$ and $g_c$ are determined according to the following equations:

$$g_p=g_{p1}+g_{p2}$$

$$g_c=g_{c1}+g_{c2}$$

The best X matches (X<16) for $g_p$ are chosen from the first stage and are used to search the second stage. The second stage is searched for the best Y matches for $E_n$ (Y<8). Finally, only the X, Y vector combinations are searched. For example, if four matches are chosen from the first stage, and two matches from the second stage, then only eight combinations need to be searched for the over-all best match. Since fewer entries need to be searched (8 vs. 128 for the single stage codebook), the search is much more efficient. However, this method requires a sophisticated arrangement of the vectors in the tables, and produces inferior quality coded speech compared to a single stage table.

Figure 4A:
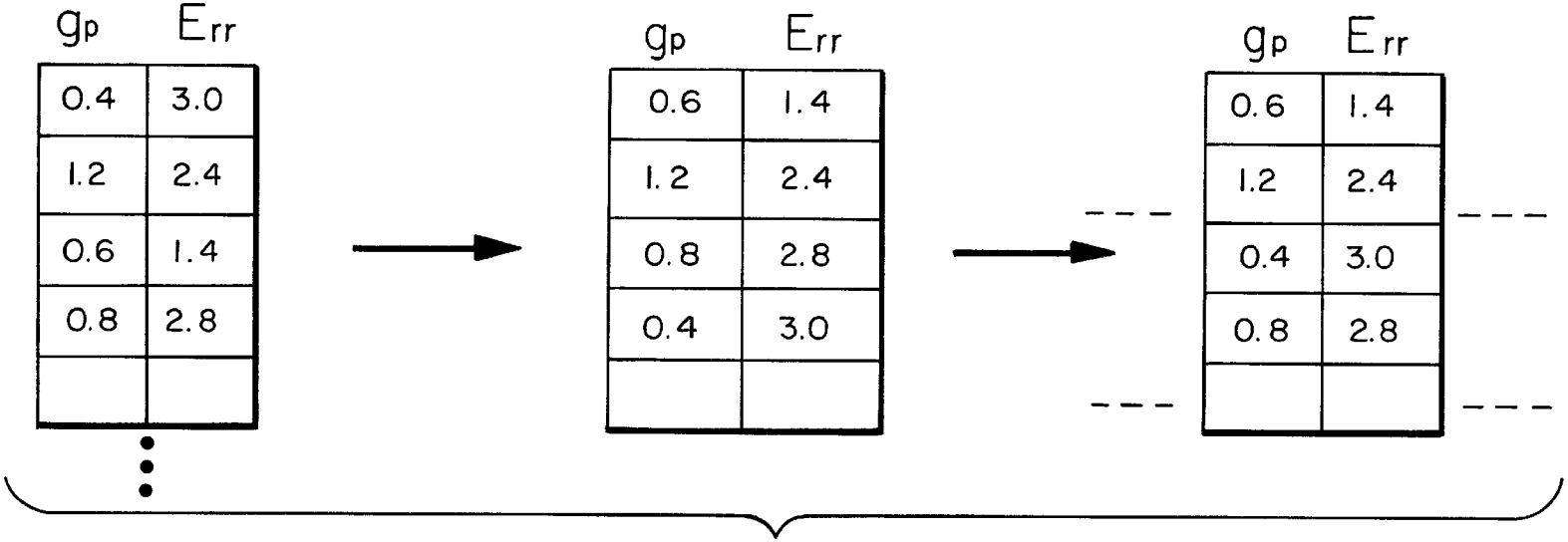
FIG. 4(A) is an example of a vector quantizer table constructed according to the present invention.
Figure 4B:
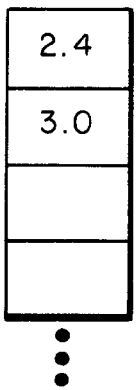
FIG. 4(B) is an example of an auxiliary scalar quantizer constructed according to the present invention.
Figure 5:
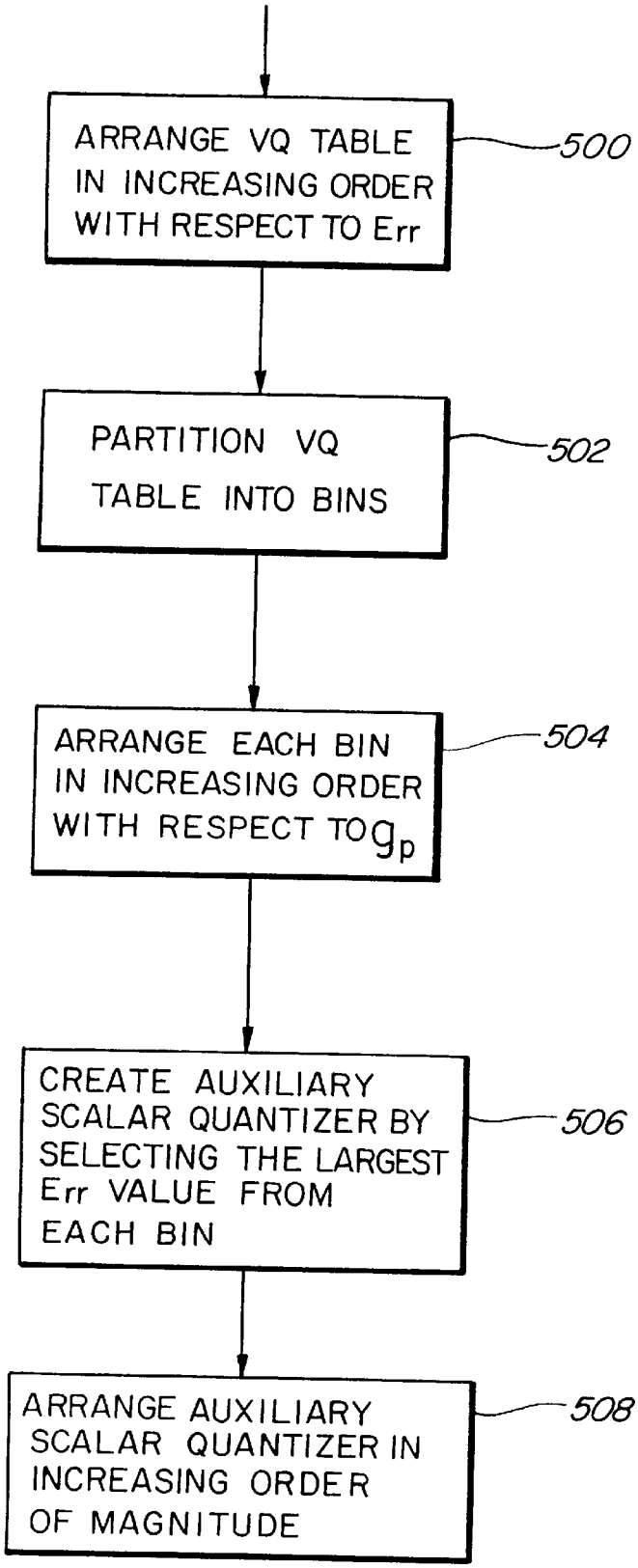
FIG. 5 is a flowchart illustrating the construction steps for constructing a vector quantizer according the present invention.

The present invention provides an efficient search scheme, similar to a two-stage quantizer, while preserving the higher quality of speech coding resulting from a single stage quantizer. FIG. 4 is a block diagram illustrating an example of an arrangement of a gain vector quantizer (VQ) constructed according to the present invention. A flowchart illustrating the steps for constructing a vector quantizer according the present invention is shown in FIG. 5. The two-dimensional entries of the VQ table are arranged in increasing order with respect to the prediction error energy, $E_n$ at step 500 (see FIG. 4(A), for example). Next, the single stage VQ table is partitioned into two-dimensional bins (step 502). The number of bins is determined by the number of bits representing $E_\pi$, i.e. if four bits are used to represent $E_n$ then $2^4$=16 bins are used. The number of entries in each bin is determined by the number of bits representing $g_p$, i.e. if three bits are used then there are eight entries per bin. The entries within each bin are arranged in increasing order of the gain $g_p$ (step 504). These steps are illustrated with an example in FIG. 4(A).

A separate auxiliary one-dimensional scalar quantizer is then created (step 506). The entries of the auxiliary one-dimensional scalar quantizer are the largest prediction error energies from each bin (i.e. one entry per bin). The entries in the auxiliary quantizer are arranged in increasing order of magnitude (step 508) as shown in FIG. 4(B). The VQ table is constructed once according to these steps. The VQ table may then be used in a speech coding system to quantize the gain values.

Figure 6:
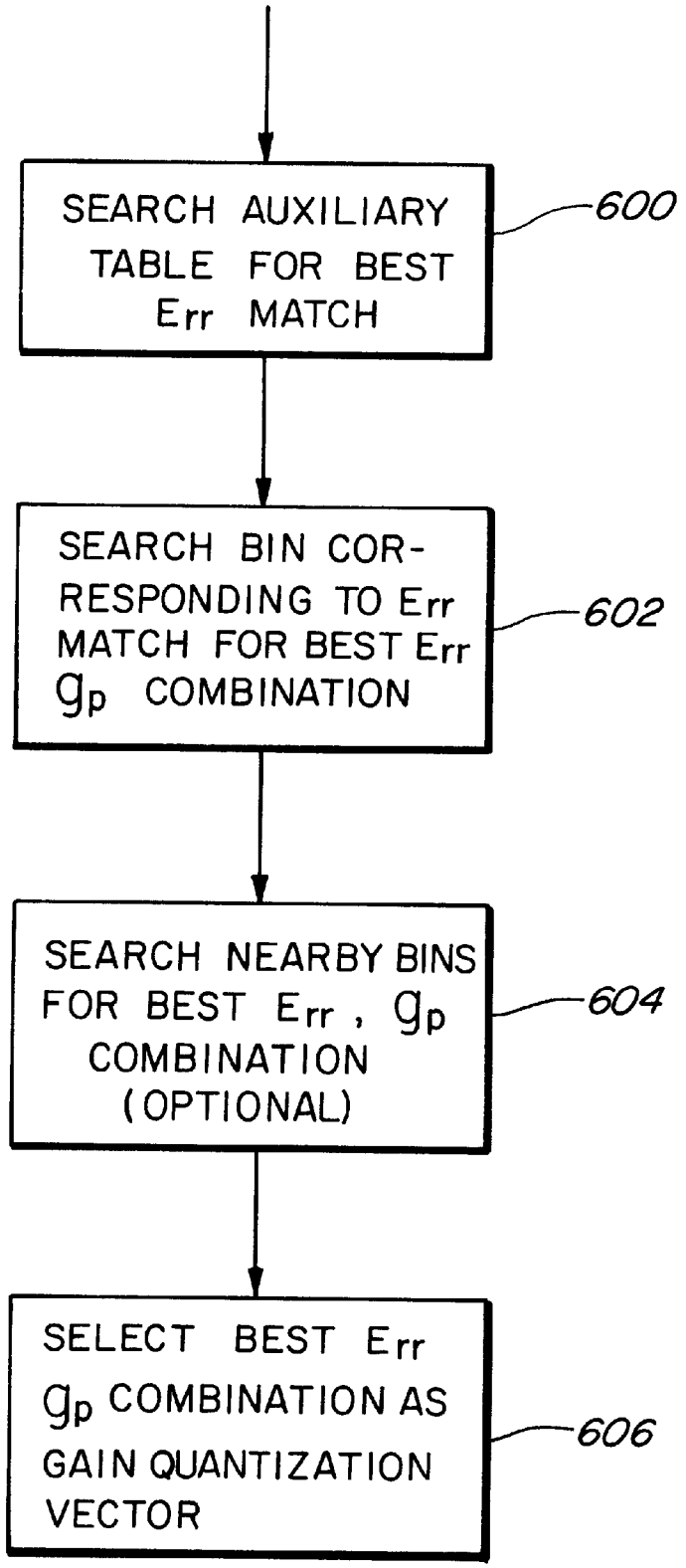
FIG. 6 is a flowchart illustrating the steps for searching a vector quantizer table constructed according to the present invention.

FIG. 6 illustrates the steps of a search of the VQ table constructed according to the present invention. First, a fast binary search is performed on the auxiliary table to pre-quantize the prediction error energy $E_n$ (step 600). Once the closest $E_n$ value is located, the bin in the VQ table corresponding to the $E_n$ value is searched for the best $E_n$ and $g_p$ combination (step 602). Depending upon the application and desired precision, several bins next to the selected bin may also be searched (step 604) for a more optimal $E_\pi$, $g_p$ combination. The best $E_\pi$, $g_p$ combination is then selected as the gain quantization vector (step 606). Since both the auxiliary scalar table and the two-dimensional VQ table are organized as described above with reference to FIG. 5, the final VQ quantization of both the adaptive codebook gain and the fixed codebook gain can be obtained by only searching a few entries.

Note that in the presently preferred embodiment, the fixed excitation gain $g_c$ is transformed into a prediction error energy $E_n$ prior to the construction of the VQ table. The present invention will also work with other gain transformations, the calculation of which are well known in the art.

The present invention thus has the advantages associated with multi-stage search schemes, and the improved coding associated with a single stage table. The present invention has the additional advantage of robustness. Due to the specific arrangement of the VQ table, the coding scheme is more robust than previous coding schemes with respect to transmissions errors. If the least significant bit(s) (LSB) of the code is corrupted during transmission, the resulting code is still in the same or nearby bin. This results in only a relatively small coding error induced by the transmission error. If the most significant bit(s) (MSB) of the code is corrupted, then the energy range is completely changed. A dramatic change in the energy value is easily detected by the receiving side, and the error can be compensated.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A method of constructing a gain-vector-quantizer table for speech coding of a speech signal, the method comprising the steps of:

establishing fixed excitation gain values, $g_c$, for representation of a first component of the speech signal and adaptive excitation gain values, $g_p$, for representation of a second component of the speech signal as entries within the table;

arranging the established entries in the table such that successive entries of the fixed excitation gain values increase with respect to one another and the adaptive excitation gain values retain their association with corresponding fixed excitation gain values;

organizing respective groups of the arranged entries into corresponding two-dimensional bins; and ordering the entries in each of the bins in increasing order with respect to the adaptive excitation gain values $g_p$ within each bin.

2. The method according to claim 1, further comprising the steps of:

creating a one-dimensional auxiliary scalar quantizer by selecting a largest fixed excitation gain value $g_c$ from each bin; and ordering the selected largest fixed excitation gain values of the created auxiliary scalar quantizer in increasing order of magnitude.

3. The method according to claim 2, wherein the fixed excitation gain values $g_c$ are first transformed into prediction error energy values, $E_\pi$, before the gain-vector-quantizer table is formed.

4. The method according to claim 3, wherein the auxiliary scalar quantizer table is created by using a largest prediction error energy value, $E_\pi$, from each bin, and wherein successive entries the auxiliary scalar quantizer table are ordered in increasing order of magnitude of $E_n$ values.

5. A method of searching a vector-quantizer table for speech coding of a speech signal, the vector-quantizer table comprising a main quantizer table, having entries of fixed excitation gain values $g_c$ and associated adaptive excitation gain values $g_p$, and an auxiliary scalar quantizer table, the excitation gain values supporting representation of components of the speech signal, wherein the main quantizer table is constructed by the steps of:

arranging the entries in the vector-quantizer table in increasing order with respect to the fixed excitation gain values $g_c$;

organizing the arranged entries into two-dimensional bins; and ordering the entries in each of the organized bins in increasing order with respect to the adaptive excitation gain values $g_p$;

and the auxiliary scalar quantizer table is constructed by the steps of:

selecting a largest fixed excitation gain value $g_c$ from each bin; and ordering successive entries in the auxiliary scalar quantizer in increasing order of magnitude of the fixed excitation $g_c$ gain values; wherein the method of searching comprises the steps of:

searching the auxiliary scalar quantizer table for a preferential fixed excitation gain value $g_c$;

searching a bin in the main quantizer table, the bin corresponding to the preferential fixed excitation gain value $g_c$, for a best $g_c$ and $g_p$ combination; and selecting the best $g_c$ and $g_p$ combination as a gain quantization vector.

6. The method according to claim 5, wherein the fixed excitation gain values $g_c$ are first transformed into prediction error energy values $E_\pi$ before the vector quantizer table is formed.

7. The method according to claim 6, wherein the auxiliary scalar quantizer table is created using a largest prediction error energy value $E_n$ from each bin, and successive entries of the auxiliary scalar quantizer table are ordered in increasing order of magnitude of $E_n$ values.

8. The method according to claim 7, wherein the auxiliary table is searched for a best prediction error energy value $E_\pi$.

9. The method according to claim 8, wherein a bin corresponding to the best prediction energy value $E_n$ is searched for a best $E_n$ and $g_p$ combination.

10. The method according to claim 5, wherein a predetermined number of bins nearest to the bin corresponding to the preferential fixed excitation gain value $g_c$ are also searched for an optimal $g_c$ and $g_p$ combination.

11. The method according to claim 9, wherein a predetermined number of bins nearest to the bin corresponding to the best prediction energy value $E_\pi$ are also searched for an optimal $E_n$ and $g_p$ combination.

12. A method of constructing a gain vector quantizer table comprising a main table and an auxiliary scalar quantizer table for speech coding, the method comprising the steps of:

establishing prediction error values $E_n$ for representation of a first component of an input speech signal and adaptive excitation gain values, $g_p$, for representation of a second component of the input speech signal as entries within the table;

arranging the established entries in the table such that successive entries of the prediction energy error values increase with respect to one another and the adaptive excitation values retain their association with corresponding prediction energy error values;

organizing respective groups of the arranged entries into corresponding two-dimensional bins; and ordering the entries in each of the bins in increasing order with respect to the adaptive excitation gain values $g_p$;

creating a one-dimensional auxiliary scalar quantizer by selecting a largest prediction energy error value $E_n$ from each bin; and ordering successive entries of the auxiliary scalar quantizer in increasing order of magnitude of the prediction energy error values $E_\pi$.

13. A method for supporting enhanced selection of gain parameters for speech coding of a speech signal, the method comprising:

establishing gain parameters comprising fixed excitation gain values and associated adaptive excitation gain values for representation of at least one component of the speech signal;

arranging the established fixed excitation gain values to increase with respect to one another in succession in a first data structure, the associated adaptive excitation values tracking corresponding fixed excitation gain values in the first data structure;

organizing groups of the fixed excitation gain values and the corresponding adaptive excitation vectors into a second data structure; and ordering the adaptive excitation values in the second data structure to increase respect to one another.

14. The method according to claim 13 further comprising:

identifying a greatest fixed excitation gain value within each second data structure as representative of a particular second data structure; and storing the identified greatest fixed excitation gain values in a third data structure.

15. The method according to claim 14 further comprising:

searching the third data structure for a preferential fixed excitation gain value among the greatest fixed excitation gain values; and searching the particular second data structure corresponding to the preferential fixed excitation gain value for selection of a preferential combination of a fixed excitation gain value and an adaptive excitation gain value based on an error minimization procedure.

16. The method according to claim 13 wherein the first data structure comprises a main vector-quantizer table of a codebook, the second data structures comprise two-dimensional bins, and wherein the third data structure comprises an auxiliary scalar quantizer table.

17. A method for supporting enhanced selection of gain parameters for speech coding of a speech signal, the method comprising:

establishing gain parameters as prediction error energy values and associated adaptive excitation gain values for representation of at least one component of the speech signal;

arranging the established prediction error energy values to increase with respect to one another in succession in a first data structure, the associated adaptive excitation values tracking corresponding prediction error energy values in the first data structure;

organizing groups of the prediction error energy values and the corresponding adaptive excitation gain values into a second data structure; and ordering the adaptive excitation values in the second data structure to increase respect to one another.

18. The method according to claim 17 further comprising:

identifying a greatest prediction error energy value within each second data structure as representative of a particular second data structure; and storing the identified greatest prediction error energy values in a third data structure.

19. The method according to claim 18 further comprising:

searching the third data structure for a preferential fixed excitation gain value among the greatest fixed excitation gain values; and searching the particular second data structure corresponding to the preferential fixed excitation gain value for selection of a preferential combination of a fixed excitation gain value and an adaptive excitation gain value based on an error minimization procedure.

20. The method according to claim 17 wherein the first data structure comprises a main vector-quantizer table of a codebook, the second data structures comprise two-dimensional bins, and wherein the third data structure comprises an auxiliary scalar quantizer table.

* * * * *